US005173107A

United States Patent [19]

Dreyer et al.

[11] Patent Number: 5,173,107

[45] Date of Patent: Dec. 22, 1992

[54] COMPOSITE HARD METAL BODY AND PROCESS FOR ITS PRODUCTION

[75] Inventors: Klaus Dreyer, Essen; Hans Kolaska, Bottrop, both of Fed. Rep. of Germany

[73] Assignee: Krupp Widia GmbH, Essen, Fed. Rep. of Germany

[21] Appl. No.: 689,237

[22] PCT Filed: Nov. 27, 1989

[86] PCT No.: PCT/DE89/00740

§ 371 Date: Jun. 10, 1991

§ 102(e) Date: Jun. 10, 1991

[87] PCT Pub. No.: WO90/07017

PCT Pub. Date: Jun. 28, 1990

[30] Foreign Application Priority Data

Dec. 16, 1988 [DE] Fed. Rep. of Germany ..... 3842439
Dec. 22, 1988 [DE] Fed. Rep. of Germany ..... 3843219

[51] Int. Cl.[5] ..... B22F 3/00

[52] U.S. Cl. ..... 75/229; 75/232; 75/233; 75/234; 75/235; 75/236; 75/237; 75/238; 75/239; 75/240; 75/241; 75/244; 419/12; 419/13; 419/14; 419/15; 419/16; 419/17; 419/18; 419/19; 419/31; 419/32; 419/33; 419/35; 419/49; 419/53; 419/55; 419/68

[58] Field of Search ..... 75/229, 232-241, 75/244; 419/12-19, 31-33, 35, 49, 53, 55, 48

[56] References Cited

U.S. PATENT DOCUMENTS

| | | | |
|---|---|---|---|
| 4,007,049 | 2/1977 | Rossi et al. | 106/58 |
| 4,259,112 | 3/1981 | Dolowy et al. | 75/229 |
| 4,463,058 | 7/1984 | Hood et al. | 75/229 |
| 4,756,791 | 7/1988 | D'Angelo et al. | 156/610 |

FOREIGN PATENT DOCUMENTS

| | | |
|---|---|---|
| 0255709A2 | 8/1986 | European Pat. Off. . |
| 0208910A1 | 1/1987 | European Pat. Off. . |
| 0289476A2 | 11/1988 | European Pat. Off. . |
| 0295228A2 | 12/1988 | European Pat. Off. . |
| 1252906 | 10/1967 | Fed. Rep. of Germany . |
| 2461801B2 | 7/1976 | Fed. Rep. of Germany . |
| 3045010A1 | 9/1981 | Fed. Rep. of Germany . |
| 3047344A1 | 10/1981 | Fed. Rep. of Germany . |
| 3221629A1 | 2/1983 | Fed. Rep. of Germany . |
| 3346539C2 | 6/1984 | Fed. Rep. of Germany . |
| 3617055A1 | 11/1986 | Fed. Rep. of Germany . |
| 3706000A1 | 9/1988 | Fed. Rep. of Germany . |
| 3834742A1 | 4/1989 | Fed. Rep. of Germany . |
| 1454756 | 8/1966 | France . |
| 2157282A | 10/1985 | United Kingdom . |

OTHER PUBLICATIONS

M. Futamoto et al Journal of Crystal Growth 61(1983) pp. 69-74 Hafnium Carbide and Nitride Whisker Growth By Chemical Vapor Deposition.

Von Gunter Nitschmann, Wetzlar VDI-Z 107 (1965) Nr.23 August (II) pp. 1133-1134 Verbundwerkstoffe mit Whiskern.

Kubota Tekko K.K.(1) / Hisashi Hiraishi(5) 59-107059 (A) Appl. No. 57-215942 Heat-Resistant Ceramic Material.

Mitsubishi Kinzoku K.K. 59-190339(A) Appl. No. 58-63436 Manufacture of Superhard Cermet For Cutting Tool With High Toughness.

S. Motojima et al Journal of Crystal Growth 87 (1988) pp. 311-317 Chemical Vapour Growth of B-Sic Whiskers From A Gas Mixture Of . . . .

H. Grewe et al Whiskerverstarkte Keramiken In: cfi/Ber. DKG 8/9-87, pp. 303, 306-308, 313-317.

A. P. Levitt; Whisker Technology In Chemical Engineering Progress, vol. 62, No. 3; Mar. 1966, pp. 51-67.

*Primary Examiner*—Stephen J. Lechert, Jr.
*Assistant Examiner*—Ngoclan T. Mai
*Attorney, Agent, or Firm*—Herbert Dubno

[57] ABSTRACT

The invention relates to a composite hard metal body of hard material, a binder and embedded reinforcing material, as well as to a process for the production of the composite hard metal body by methods of powder metallurgy.

In order to create a composite hard metal body with improved toughness under load, improved hardness and a lower fracture susceptibility, the invention proposes to build in monocrystalline, preferably needle-shaped and/or platelet-shaped reinforcing materials, coated with an inert layer with respect to the binder metal phase and consisting of borides and/or carbides, and/or nitrides and/or carbonitrides of the elements of Groups IVa or Va or mixtures thereof and/or coated monocrystalline reinforcing material of SiC, $Si_3N_4$, $Si_2N_2O$, $Al_2O_3$, $ZrO_2$, AlN and/or BN.

The composite hard metal body is produced by powder-metallurgical methods, whereby the reinforcing material in a deagglomerated and graded state, optionally coated by CVD or PVD with a layer which is inert with respect to the binder metal phase, is blended with the ground mixture of hard materials and binder, dried, granulated, uniaxially pressed or isostatically pressed at low temperatures and then the composite body is produced by sintering, respectively a combined or separate sintering/HIP-process or through axial hot-pressing. The axial hot-pressing is preferred in cases where the reinforcing material surpasses 20% by volume, under this level the other mentioned processes are preferred.

17 Claims, No Drawings

COMPOSITE HARD METAL BODY AND PROCESS FOR ITS PRODUCTION

CROSS REFERENCE TO RELATED APPLICATIONS

This application is a National Phase of PCT/DE 89/00740 filed Nov. 27, 1989 and based, in turn upon German National Applications P 38 42 439.8 filed Dec. 16, 1988 and P 38 43 219.6 filed Dec. 22, 1988 under the International Convention.

FIELD OF THE INVENTION

The invention relates to a composite hard metal body, consisting of phases of hard material, such as tungsten carbide and/or carbides, or nitrides of elements of the Group IVb or Group Vb of the classification of elements, of reinforcing materials and of a binder metal phase such as cobalt and/or iron and/or nickel, and to a process for producing the composite hard metal body by methods of powder metallurgy.

BACKGROUND OF THE INVENTION

Monocrystal materials known in the art have outstanding mechanical characteristics, such as tensile and shearing strength.

Austrian Patent 259 242 describes a sintered hard metal consisting of hard materials and binders, containing hard materials in the form of needle-shaped monocrystals in an amounts of at least 0.1%, preferably 0.5 to 1.5% of the entire content of hard materials. In order to produce these sintered hard metals, WC in the form of needle-shaped monocrystals is added to the hard-material component prior to grinding. After the addition of a binder from the iron group, the hard metal mixture is pressed and sintered with the formation of a liquid phase. However, it is disadvantageous that the monocrystalline WC dissolves to a great extent in the binder phase (compare German publication "Metall", July 1974, Part 7). The hard-metal monocrystals are not able to achieve a noticeable improvement of wear resistance, especially because the maximum amount of hard-metal monocrystals to be added is set by the proportion of grains of hard material (grains with a mean diameter of less than 2 μm) to be replaced.

OBJECTS OF THE INVENTION

It is an object of the present invention to provide a composite hard metal body having improved toughness, improved hardness even under a high thermal load and a lower susceptibility to fracture.

Furthermore, it is an object of the present invention to provide an improved process for the production of such a composite hard metal body.

SUMMARY OF THE INVENTION

These objects are attained periodic with a composite hard metal body having a composition consisting of phases of hard material, such as tungsten carbide and/or carbides or nitrides of the elements of Groups IVb or Vb of the classification of elements, of reinforcing materials and of a binder metal phase such as cobalt and/or iron and/or nickel. The body includes either a monocrystalline platelet-shaped reinforcing material made of borides and/or carbides and/or nitrides and/or carbonitrides of the elements of Group IVb (Ti, Zr, Hf), Vb (V, Nb, Ta) or VIb (Cr, Mo, W) or mixtures thereof and/or of SiC, $Si_3N_4$, $Si_2N_2O$, $Al_2O_3$, $ZrO_2$, AlN and/or BN and/or monocrystalline needle-shaped reinforcing material made of SiC, $Si_3N_4$, $Si_2N_2O$, $Al_2O_3$, $ZrO_2$, AlN, and/or BN.

The proportion of the reinforcing materials is between 2 to 40% by volume, preferably 10 to 20% by volume.

Another object of the present invention is to provide a process for the production of such a composite hard metal body. The composite body according to the invention can thus have two kinds of reinforcement materials, monocrystalline platelet-shaped materials known as platelets and monocrystalline needle-shaped materials i.e. whiskers, sometimes also filaments. The platelets include borides, carbides, nitrides and/or carbonitrides of elements of the Groups IVb to VIb, SiC, $Si_3N_4$, $Si_2N_2O$, $Al_2O_3$, $ZrO_2$, AlN and/or BN or mixtures of the aforementioned platelets.

The whiskers are SiC, SiC, $Si_3N_4$, $Si_2N_2O$, $Al_2O_3$, $ZrO_2$, AlN and/or BN or mixtures of the aforementioned whiskers.

The use of needle-shaped monocrystals or whiskers, has already been proposed in other materials. For instance, the U.S. Pat. No. 3,441,392 discloses a fiber-reinforced metal alloy, produced by methods of powder metallurgy and which contains for instance fibers of α-aluminum oxide and silicon carbide.

U.S. Pat. No. 4,543,345 describes a ceramic material ($Al_2O_3$-matrix) with embedded SiC-whiskers.

From the German 33 03 295 Al it is known that the strength and fracture-resistance characteristics of a ceramic material reinforced with silicone carbide fibers is improved compared to the ceramic matrix. Similar indications can also be found in the German publication ZwF 83 (1988) 7, pages 354 to 359.

The EP 0 067 584 B1 describes a process for the production of a composite material starting with metallic, ceramic, glass or plastic basic material reinforced by homogeneously and uniformly distributed deagglomerated silicon carbide whiskers, wherein the silicon carbide whiskers are blended into a polar solvent in order to create a slurry which is subsequently ground in order to produce a slurry of deagglomerated silicon carbide whiskers, the resulting slurry being mixed with a basic material in order to form a homogenous mixture, then dried and formed into a blank.

Finally, from EP 0 213 615 A2 composite materials are known wherein in a metallic matrix silicon carbide and silicon nitride whiskers are contained.

However, the introduction of larger amounts of needle- or platelet-shaped monocrystals in hard metals has never been performed before, because it was feared that the monocrystals could dissolve in the liquid binder phase. In fact, the solubility of WC in a binder such as cobalt is high, and as a result the use of WC whiskers—such as proposed by Austrian Patent 259 242—does not improve the wear resistance.

Compared to whiskers, the platelet-like monocrystals have a considerably wider width or diameter at a thickness in the size range of the whisker diameters.

For instance, the whiskers preferably have a length of 3 μm to 100 μm and/or a diameter of 0.1 to 10 μm. In opposition thereto, the platelets are preferably characterized by a thickness of 0.5 μm to 10 μm and a diameter (of the larger platelet surface) of 3 μm to 100 μm. In preferred embodiments, SiC-whiskers or platelets are used, which are formed at more than 90% of the β-structure. The amount of whiskers or platelets lies within the range of 2 to 40% by volume, preferably 10 to 20% by volume.

However, a particular advantage of an inert whisker or platelet coating resides in the fact that a controlled consistency of the binder with the matrix can be established. Altogether, the embedding of coated whiskers or platelets leads to increased hardness with simultaneous improvement of the tenacity, namely also at high temperatures, such as can be found in cutting materials. Advantageously, these results are achieved also in the case of such hard metals with a low content of binders (less than 8% by volume).

Furthermore, the inert coating fulfills a certain protection function of the coated monocrystals, i.e. the monocrystals can not dissolve in the binder, particularly it is possible for the first time to use WC-monocrystals in amounts which are significant for the hard metal composition.

Preferred coating materials are carbides, nitrides and/or carbonitrides of Group IVb of the classification of elements and/or $ZrO_2$, $Al_2O_3$ and/or BN. The thickness of the coating ranges between 0.2 μm and a maximum of 2/10 of the whisker diameter or the platelet thickness, preferably between 0.05 μm and 1/10 of the whisker diameter or the platelet thickness. The coating of the whiskers and/or platelets is preferably carried out through the state of the art chemical vapor deposition (CVD) or plasma vapor deposition (PVD) processes.

The process of the invention subjects a composition with contents up to 20% by volume of reinforcing materials to sintering, or a combined sintering/HIP (high-temperative isostatic pressing) process or sintering with subsequent high-temperature isostatic pressing in separate installations while in the case of higher reinforcement material contents hot-pressing is preferred.

The production of composite whisker hard metal materials is essentially based on known powder-metallurgy process steps. So, as opposed to the state of the art, the reinforcement materials (whiskers, platelets) are first prepared, deagglomerated and graded, before they are subjected to further process steps. Basically, four densification processes are defined: the usual sintering, a combined sintering/HIP process, wherein directly on heating in the sintering process a high-temperature isostatic pressing at 20 to 100 bar, maximum 200 bar, is superimposed, the sintering with subsequent high-temperature isostatic pressing under pressures of approximately 1000 bar in a separate installation and finally the mentioned hot pressing.

In an example of the invention, to a mixture of 4% by volume Co, balance WC immediately after the wet grinding, WC-whiskers in deagglomerated and graded form, which have been coated with TiC with the state of the art CVD process, are added. The entire mixture was subsequently dried, granulated and prepressed into a green compact by isostatic pressing at low temperatures, prior to the finishing of the composite whisker materials by hot pressing.

Altogether, the composite hard metal body of the invention possesses improved hardness and strength values when compared to composite materials known to the state of the art. The toughness under load is higher and the fracture risk lower, without increasing the binder contents.

We claim:

1. A composite hard metal body comprising:

a matrix of a binder metal material selected from the group consisting of cobalt, iron, nickel or combinations thereof;

a first phase of hard material integrated in said matrix and selected from the group consisting of tungsten carbide, or the carbides and nitrides of an element selected from the Group IVb or Group Vb of the Periodic Table; and a monocrystalline reinforcing material second phase in said matrix in an amount of 2 to 40% by volume and selected from the group which consists of:

platelet reinforcing materials selected from the group consisting of borides, carbides, nitrides, carbonitrides of the elements Ti, Zr, Hf, V, Nb, Ta, Cr, Mo, W, of SiC, $Si_3N_4$, $Si_2N_2O$, $Al_2O_3$, $ZrO_2$, AlN, and BN, and mixtures thereof, and a mixture of said platelet reinforcing materials and needle reinforcing materials selected from the group consisting of SiC, $Si_3N_4$, $Al_2O_3$, $ZrO_2$, AlN, BN and mixtures thereof, said platelet and needle reinforcing materials being present in a minimum of 2% by volume.

2. The composite hard metal body defined in claim 1 wherein said monocrystalline material is coated with a layer which is inert with respect to said matrix.

3. The composite hard metal body defined in claim 1 wherein said needle reinforcing material comprises whiskers having a length between 3 μm and 100 μm.

4. The composite hard metal body defined in claim 1 wherein said needle reinforcing material comprises whiskers having a diameter between 0.1 to 10 μm.

5. The composite hard metal body defined in claim 1 wherein said platelet reinforcing material has platelets of a thickness of 0.5 μm to 10 μm and a diameter of 3 μm to 100 μm.

6. The composite hard metal body defined in claim 1 wherein said monocrystalline reinforcing material second phase is SiC and includes at least 90% of a αSiC structure.

7. The composite hard metal body defined in claim 2 wherein said layer is 0.02 μm to 0.2 μm in a diameter of the needle reinforcing material or a thickness of the platelet reinforcing material, said layer being selected from the group consisting of carbides, nitrides or carbonitrides of a element selected from Ti, Zr, Hf, $ZrO_2$, $Al_2O_3$ and BN.

8. The composite hard metal body defined in claim 7 wherein said layer is coated by vapor deposition, said reinforcing material being present in an amount of 10 to 20% by volume.

9. A process for the production of a composite hard metal body, said process comprising the steps of:

(a) preparing a matrix of binder material selected from the group consisting of cobalt, iron, nickel and mixtures thereof;

(b) grinding a first phase of hard material selected from the group consisting of tungsten carbide, and carbides and nitrides of an element selected from the Group IVb or Group Vb of the Periodic Table with said matrix, thereby forming a ground mixture of said binder and hard materials;

(c) deagglomerating a monocrystalline reinforcing material second phase in an amount of 2 to 40% by volume and selected from the group which consists of:

platelet reinforcing materials selected from the group consisting of borides, carbides, nitrides, carbonitrides of the elements of Ti, Zr, Hf, V, Nb, Ta, Cr, Mo, W and SiC, and of $Si_3N_4$, $Si_2N_2O$, $Al_2O_3$, $ZrO_2$, AlN, and BN and mixtures thereof, and needle reinforcing materials selected from the group consisting of SiC, $Si_3N_4$, $Al_2O_3$, $ZrO_2$, AlN, BN and mixtures thereof;

(d) thereafter grading said reinforcing material;

(e) thereafter mixing said selected and graded reinforcing material with the ground mixture of hard and binder materials forming thereby a composite mixture;

(f) thereafter drying said composite mixture at a low temperature; and (g) thereafter consolidating said dried composite mixture

10. The process defined in claim 9 wherein said step (g) includes pressing said composite mixture uniaxially.

11. The process defined in claim 9 wherein said step (g) includes pressing said mixture isostatically, said reinforcing material being at most 20% by volume of the composite body.

12. The process defined in claim 9 wherein said step (g) includes hot isostatic pressing.

13. The process defined in claim 9, wherein said (g) includes cooling said composite mixture, said reinforcing material being at least 20% by volume of said hard composite body.

14. The process defined in claim 13, further comprising the step of axially hot-pressing said cooled composite mixture.

15. The process defined in claim 9 wherein said step (c) comprises the step of coating said reinforcing material with a layer selected from the group consisting of carbides, nitrides or carbonitrides of the element selected from Ti, Zr, Hf, $ZrO_2$, $Al_2O_3$ and BN.

16. The process defined in claim 15 wherein said coating step is a chemical vapor deposition step.

17. The process defined in claim 15 wherein said coating step is a plasma vapor deposition step.

* * * * *